US009622580B2

(12) United States Patent
Slongo et al.

(10) Patent No.: US 9,622,580 B2
(45) Date of Patent: Apr. 18, 2017

(54) TILT MECHANISM FOR A CHAIR AND CHAIR

(71) Applicant: L&P PROPERTY MANAGEMENT COMPANY, South Gate, CA (US)

(72) Inventors: Alessandro Slongo, Mogliano Veneto (IT); Mark Grant Jones, Chorley (GB)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/770,883

(22) PCT Filed: Feb. 20, 2014

(86) PCT No.: PCT/EP2014/053346
§ 371 (c)(1),
(2) Date: Aug. 27, 2015

(87) PCT Pub. No.: WO2014/131689
PCT Pub. Date: Sep. 4, 2014

(65) Prior Publication Data

US 2016/0007754 A1 Jan. 14, 2016

(30) Foreign Application Priority Data

Feb. 27, 2013 (EP) ..... 13156910

(51) Int. Cl.
*A47C 1/032* (2006.01)
*A47C 7/00* (2006.01)

(52) U.S. Cl.
CPC ..... *A47C 1/03272* (2013.01); *A47C 1/032* (2013.01); *A47C 1/03255* (2013.01); *A47C 1/03294* (2013.01); *A47C 7/006* (2013.01)

(58) Field of Classification Search
CPC ..... A47C 1/032; A47C 1/03272; A47C 1/03255; A47C 1/03294
See application file for complete search history.

(56) References Cited

U.S. PATENT DOCUMENTS 3,662,983 A * 5/1972 Wolters ..... A47C 3/026 248/575
4,595,236 A 6/1986 Rizzoli et al.
(Continued)

FOREIGN PATENT DOCUMENTS

DE 9109184 U1 10/1991
EP 1172049 A1 1/2002
(Continued)

OTHER PUBLICATIONS

International Preliminary Report on Patentability dated Sep. 11, 2015 in Application No. PCT/EP2014/053346, 5 pages.
(Continued)

*Primary Examiner* — Philip Gabler
(74) *Attorney, Agent, or Firm* — Shook, Hardy & Bacon, L.L.P.

(57) ABSTRACT

A tilt mechanism for a chair comprises a base, a first support configured to support a chair seat and a second support configured to support a chair back, the second support is pivotably coupled to the base. A coupling mechanism couples the second support to both the base and the first support. The coupling mechanism comprises a pin attached to the first support, a first linear guide slot provided on the base, and a second linear guide slot provided on the second support. The pin is slideably received in both the first linear guide slot and the second linear guide slot. The second linear guide slot slopes upwardly in a forward direction of the tilt mechanism when the tilt mechanism is in a zero-tilt position.

13 Claims, 8 Drawing Sheets

(56) References Cited

U.S. PATENT DOCUMENTS

| | | | | |
|---|---|---|---|---|
| 4,720,142 | A | 1/1988 | Holdredge et al. | |
| 4,796,950 | A | 1/1989 | Mrotz et al. | |
| 5,228,748 | A | 7/1993 | Neumuller et al. | |
| 5,333,368 | A | 8/1994 | Kriener et al. | |
| 5,340,194 | A | 8/1994 | Neumuller | |
| 5,397,165 | A | 3/1995 | Grin et al. | |
| 5,664,834 | A | 9/1997 | Hsu | |
| 6,059,363 | A | 5/2000 | Roslund, Jr. et al. | |
| 6,419,320 | B1 | 7/2002 | Wang | |
| 6,447,063 | B1 | 9/2002 | Beggs | |
| 6,945,602 | B2 | 9/2005 | Fookes et al. | |
| 7,614,697 | B1 * | 11/2009 | Lai | A47C 1/03255 297/301.1 |
| 9,241,570 | B2 * | 1/2016 | Jones | A47C 1/03255 |
| 2002/0195856 | A1 | 12/2002 | Caruso et al. | |
| 2006/0202529 | A1 | 9/2006 | Johnson et al. | |
| 2008/0054700 | A1 | 3/2008 | Meidan | |
| 2009/0218864 | A1 | 9/2009 | Parker et al. | |
| 2009/0267394 | A1 | 10/2009 | Bock | |
| 2012/0007400 | A1 | 1/2012 | Behar et al. | |
| 2012/0086251 | A1 | 4/2012 | Parker et al. | |

FOREIGN PATENT DOCUMENTS

| | | | |
|---|---|---|---|
| TW | 200950726 | A | 12/2009 |
| WO | 2010097818 | A1 | 9/2010 |
| WO | 2010103554 | A1 | 9/2010 |
| WO | 2013004253 | A1 | 1/2013 |

OTHER PUBLICATIONS

International Search Report and Written Opinion dated Mar. 17, 2014 in Application No. PCT/EP2014/053346, 7 pages.

International Search Report dated Feb. 18, 2011 in Application No. PCT/EP2010/005215, 10 pages.

Non-Final Office Action dated May 18, 2015 in U.S. Appl. No. 13/818,866, 9 pages.

Notice of Allowance dated Aug. 19, 2015 in U.S. Appl. No. 13/818,866, 5 pages.

* cited by examiner

TILT MECHANISM FOR A CHAIR AND CHAIR

CROSS-REFERENCE TO RELATED APPLICATIONS

This application claims priority under 35 U.S.C. §365 to PCT/EP2014/053346, filed on Feb. 20, 2014, entitled "Tilt Mechanism for a Chair and Chair," and European Patent Application No. EP13156910.5, filed Feb. 27, 2013, entitled "Tilt Mechanism for a Chair and Chair," the entirety of the aforementioned applications are incorporated by reference herein.

FIELD OF THE INVENTION

The invention relates to a tilt mechanism for a chair and a chair. The invention relates in particular to a tilt mechanism for a chair having a chair seat and a chair back, with the tilt mechanism allowing the chair seat to be displaced and the chair back to be reclined in a coordinated manner.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. One common configuration for such a chair includes a chair base assembly and a pedestal column supporting the superstructure of the chair. The superstructure may include components which enable the user to adjust certain settings of the chair and to facilitate recline or "tilt" of the chair superstructure, including the seat and back of the chair. This basic chair configuration allows users to change their sitting position in the chair as desired, such that fatigue may be minimized during long sitting periods.

In recent years, chair designs have implemented a feature where a chair back and seat both move simultaneously during a tilting or rearwardly reclining motion of the chair back. The chair seat may also tilt in this process or may be displaced otherwise relative to the chair base. The combined movement of the chair back and seat in these designs results in some level of improvement for the occupant through a range of tilting motions over a conventional "static" chair without coordinated back and seat movement.

Various configurations may be realized to implement such a coordinated motion of the chair back and chair seat. For illustration, a back support supporting the chair back may be coupled to a seat support supporting the chair seat via a pivot coupling. Such a pivot coupling may restrict the movement of the rear portion of the seat to a radial movement. Such a purely radial movement may give rise to undesired conditions, such as "shirt shear" or "bridging" conditions. If a shirt shear occurs, the occupant's shirt may be untucked, which is undesirable. When the bridging condition occurs, the lower portion of the chair back falls away from the occupant during recline. In such a condition, the occupant's lumbar region may be largely unsupported by the chair back.

More complex configurations of tilt mechanisms may be realized, in order to make it less likely for undesired conditions to occur during recline. For illustration, the tilt mechanism of WO 2012/025134 A allows more complex relative movements of the chair seat and chair back to be defined. The tilt mechanism of WO 2012/025134 A1 comprises a first coupling mechanism and a second coupling mechanism, which respectively comprise a linear guide slot. While such tilt mechanisms offer significant advantages in terms of comfort and use, the complexity and, thus, cost of such more complex mechanisms may be undesirable in some cases. Other examples for tilt mechanisms are disclosed in U.S. Pat. No. 5,333,368 A or in U.S. Pat. No. 7,614,697 B1.

Some complex configurations of chair superstructures, for example of the type using additional link members articulated to both the seat support and the backrest support, may be complicated to re-design so as to accommodate the design constraints imposed by different types of chairs. Different types of chairs may impose different constraints on the mechanism. For illustration, the chair tilt mechanism should be able to move between the zero tilt and the full tilt position, while not moving the occupant's center of gravity relative to the chair base assembly so much that an overbalancing or tipping occurs. The shift in center of gravity which is acceptable depends on the configuration of the chair base assembly. It may be desirable to implement a chair tilt mechanism which can be easily adapted to different chair requirements.

For enhanced comfort, it may also be desirable to provide a tilt mechanism which has self-weighing characteristics. For such tilt mechanisms, the movement of a chair seat induced by reclining movement of the chair back provides a counterforce onto the chair back, resulting in recline characteristics which adapt to the user's weight.

BRIEF SUMMARY OF THE INVENTION

There is a continued need in the art for a chair tilt mechanism and a chair which address some of the above needs. In particular, there is a continued need in the art for a chair tilt mechanism which has a simple and reliable construction, and which provides self-weighing characteristics.

According to an embodiment, a tilt mechanism is provided. The tilt mechanism comprises a base, a first support configured to support a chair seat, and a second support configured to support a chair back and pivotably coupled to the base. The tilt mechanism comprises a coupling mechanism which couples the second support to the base and the first support. The coupling mechanism comprises a pin attached to the first support, a first linear guide slot provided on the base, and a second linear guide slot provided on the second support. The pin is slideably received in both the first linear guide slot and the second linear guide slot. The second linear guide slot slopes upwardly in a forward direction of the tilt mechanism when the tilt mechanism is in a zero-tilt position, to drive the pin along the first linear guide slot when the second support pivots relative to the base.

In this tilt mechanism, the second linear guide slot drives the pin along the first linear guide slot when the chair back is tilted rearward. This provides a certain degree of flexibility in defining the movement of the rear end of the first support, while providing a simple construction of the coupling mechanism. The characteristics of the tilt mechanism may be altered by appropriately selecting the slope of the first and second linear guide slots during manufacture. The tilt mechanism in which the second linear guide slot slopes upwardly in the forward direction provides self-weighing characteristics.

The first support may be displaceably mounted to the base.

The pin may extend through both the first linear guide slot and the second linear guide slot. The pin may extend across the base, from one side wall of the base to the opposite side wall of the base.

The second linear guide slot may be configured to drive the pin along the first linear guide slot via a shear action.

The second linear guide slot may alter its direction relative to the forward direction and may remain sloped upwardly relative to the forward direction when the second support pivots relative to the base.

The first linear guide slot may slope downwardly in a forward direction of the tilt mechanism.

The first linear guide slot may have a longitudinal axis arranged at a first angle relative to the forward direction. The first angle may be included in a range from 32° to 45°.

The second linear guide slot may have a longitudinal axis arranged at a second angle relative to the forward direction. The second angle may be included in a range from 45° to 55° when the tilt mechanism is in a zero-tilt position.

The first linear guide slot may have a slot length which is greater than a slot length of the second linear guide slot.

The tilt mechanism may further comprise a link which couples the first support to the base. The link may be articulated to the base and to the first support.

The tilt mechanism may further comprise an energy storage mechanism coupled to the link.

The energy storage mechanism may be coupled to both the pin and the link.

The coupling mechanism may further comprises a first keyed sleeve projecting into the first linear guide slot and a second keyed sleeve projecting into the second linear guide slot. The first keyed sleeve and the second keyed sleeve may be mounted to the pin.

The coupling mechanism may comprise a further first linear guide slot on the base. The first linear guide slot and the further first linear guide slot may be provided on opposing side walls of the base.

The coupling mechanism may comprise a further second linear guide slot on the second support. The second linear guide slot and the further second linear guide slot may be provided on opposing side walls of the second support.

According to another embodiment, a chair is provided. The chair comprises a chair base assembly, a chair seat, a chair back and a tilt mechanism. The tilt mechanism comprises a base, a first support supporting a chair seat, and a second support supporting a chair back and pivotably coupled to the base. The tilt mechanism comprises a coupling mechanism which couples the second support to the base and the first support. The coupling mechanism comprises a pin attached to the first support, a first linear guide slot provided on the base, and a second linear guide slot provided on the second support. The pin is slideably received in both the first linear guide slot and the second linear guide slot. The second linear guide slot slopes upwardly in a forward direction of the tilt mechanism when the tilt mechanism is in a zero-tilt position, to drive the pin along the first linear guide slot when the second support pivots relative to the base.

The tilt mechanism may be the tilt mechanism of any aspect or embodiment of the invention.

The tilt mechanism and chair according to embodiments provide a simple construction while offering self-weighing characteristics. By using two linear guide slots, a first guide slot and a second guide slot, and a pin which is slideably received in and extends through both the first and the second linear guide slot, the movement of the second linear guide slot drives the pin along the first linear guide slot by a shear action when the chair back is reclined.

The tilt mechanism and chair according to embodiments may be utilized for various applications in which a coordinated reclining motion of the chair back and motion of the chair seat is desired. For illustration, the chair tilt mechanism may be utilized in an office chair.

BRIEF DESCRIPTION OF DRAWINGS

Embodiments of the invention will be described with reference to the accompanying drawings.

DETAILED DESCRIPTION OF EMBODIMENTS

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise.

According to embodiments, a tilt mechanism is provided which generally includes a base, a first support for supporting a chair seat and a second support for supporting a chair back. In use of the tilt mechanism, the chair seat may be fixedly mounted to the first support and the chair back may be fixedly mounted to the second support. The first support is displaceably mounted to the base. A coupling mechanism is provided which couples the second support to both the base and the first support. The coupling mechanism has a first linear guide slot in the base, a second linear guide slot in the second support, and a pin which is slideably received in and extends through both the first linear guide slot and the second linear guide slot. The second linear guide slot, i.e. the linear guide slot provided in the second support, is inclined such that it extends downward in a forward direction of the tilt mechanism.

The tilt mechanism may have a compact and simple construction, with the coupling mechanisms implemented in a structure disposed below the chair seat. The tilt mechanism may provide self-weighing characteristics.

Figure 1:
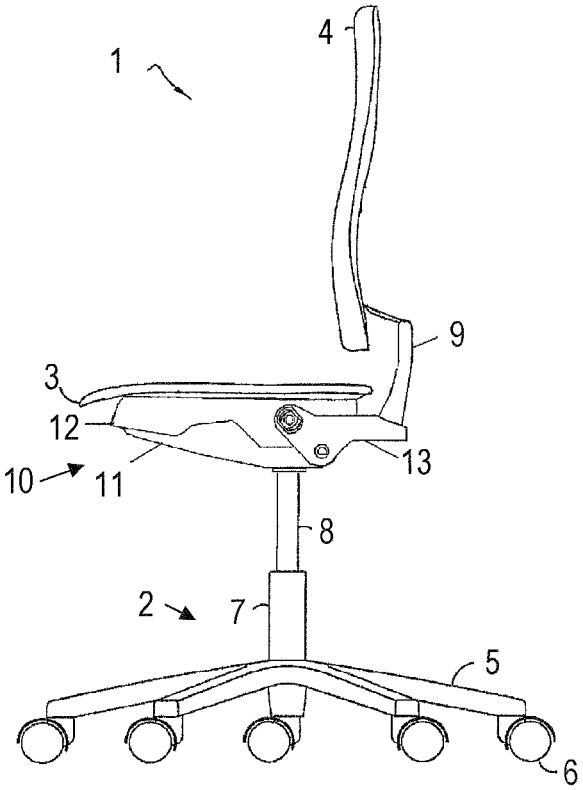
FIG. 1 is a schematic view of a chair having a chair tilt mechanism according to an embodiment.

FIG. 1 shows a chair 1 which includes a tilt mechanism 10 of an embodiment. The chair 1 is illustrated to be an office-type chair having a chair base assembly 2 and a superstructure. The superstructure includes a chair seat 3, a chair back 4 and components to interconnect the seat 3 with the back 4. The components, which will be described in more detail below, include a tilt mechanism for effecting a coordinated motion of the back 4 and the seat 3. The base assembly 2 includes a pedestal column 7, a number of support legs 5 extending radially from the column 7 and a corresponding number of castors 6 operably supported on the outer ends of the support legs 5. Additionally, a gas cylinder 8 or other lifting mechanism may be supported by the column 7 to enable the height of the seat 3, and thus of the chair superstructure, to be adjusted by an occupant.

It should be understood that the terms "forward", "rearward" and "lateral", as used herein, each have a particular meaning that is defined in relation to a flat support surface beneath the chair 1 (e.g., parallel to a floor on which castors 6 rest) and in relation to an occupant of the chair. For instance, the term "forward" refers to a direction moving away from the back 4 and in front of a chair occupant along an axis which extends parallel to such a flat support surface, while the term "rearward" refers to a direction opposite of the forward direction. The term "lateral" refers to a generally horizontal direction perpendicular to both the forward and rearward direction and extending parallel to the aforementioned flat support surface. The tilt mechanism also defines a rearward direction, to which the second support extends, and an opposing forward direction. The attachment between a base of the tilt mechanism and the chair base assembly 2 also defines which plane of the tilt mechanism will be oriented horizontally in the installed state of the tilt mechanism.

The chair 1 includes a tilt mechanism 10. Generally, the tilt mechanism 10 is operative to implement a coordinated motion of the seat 3 and of the back 4 when the back 4 is tilted. The tilt mechanism 10 includes a base 11 which, in the installed state of the tilt mechanism in which the tilt mechanism 10 is incorporated into a chair as illustrated in FIG. 1, is coupled to the pedestal column 7. The tilt mechanism 10 includes a seat support 12 which, in the installed state of the tilt mechanism 10, is directly coupled to the seat 3 and supports the seat 3 at a lower side thereof. The seat support 12 acts as first support which is displaceably mounted to the base 11. The seat 3 may be fixedly coupled to the seat support 11, such that a translational and/or rotational motion of the seat support 12 causes the seat 3 to move jointly with the seat support 12 in a translational and/or rotational manner. The tilt mechanism 10 includes a back support 13 which, in the installed state of the tilt mechanism 10, is coupled to the back 4. The back 4 may be attached to the back support 13 using suitable connecting members, such as a bar 9 affixed to the back support 13. The bar 9 may be directly and rigidly attached to the back support 13. The back support 13 acts as a second support.

As will be described in more detail with reference to FIGS. 2-15, the tilt mechanism 10 is configured such that the back support 13 is pivotably coupled to the base 11, allowing the back support 13 to pivot relative to the base 11. The tilt mechanism 10 has a coupling mechanism coupling both the seat support 12 and the back support 13 to the base 11. The coupling mechanism includes a first linear guide slot formed on the base 11, a second linear guide slot formed on the back support 13, and a pin attached to the seat support 12. The pin is slideably received in both the first linear guide slot and the second linear guide slot.

When the back 4 is tilted, the second linear guide slot drives the pin along the longitudinal axis of the first linear guide slot via a shear action. When the back 4 is tilted, the seat support 12 is thereby displaced relative to the base 11 and, thus, relative to the chair base assembly 2, by the coupling mechanism.

As used herein, the term "linear guide slot" refers to a slot having a linear center axis, extending linearly from one end of the slot to the opposite end of the slot along the slot longitudinal axis. The linear slot may respectively be formed as a cut-out, i.e., a through slot, or as a blind slot.

The tilt mechanism 10 may include a biasing mechanism to bias the tilt mechanism into a position in which the back 4 is in its frontmost position. This state, corresponding to the rest state of the tilt mechanism 10, will also be referred to as zero-tilt position. The tilt mechanism may also be configured to limit the reclining motion of the back 4. The state in which the mechanism prevents the back 4 from being reclined further will also be referred to as full-tilt state.

Configurations of the tilt mechanism according to embodiments will be described in more detail with reference to FIGS. 2-15.

Figure 2:
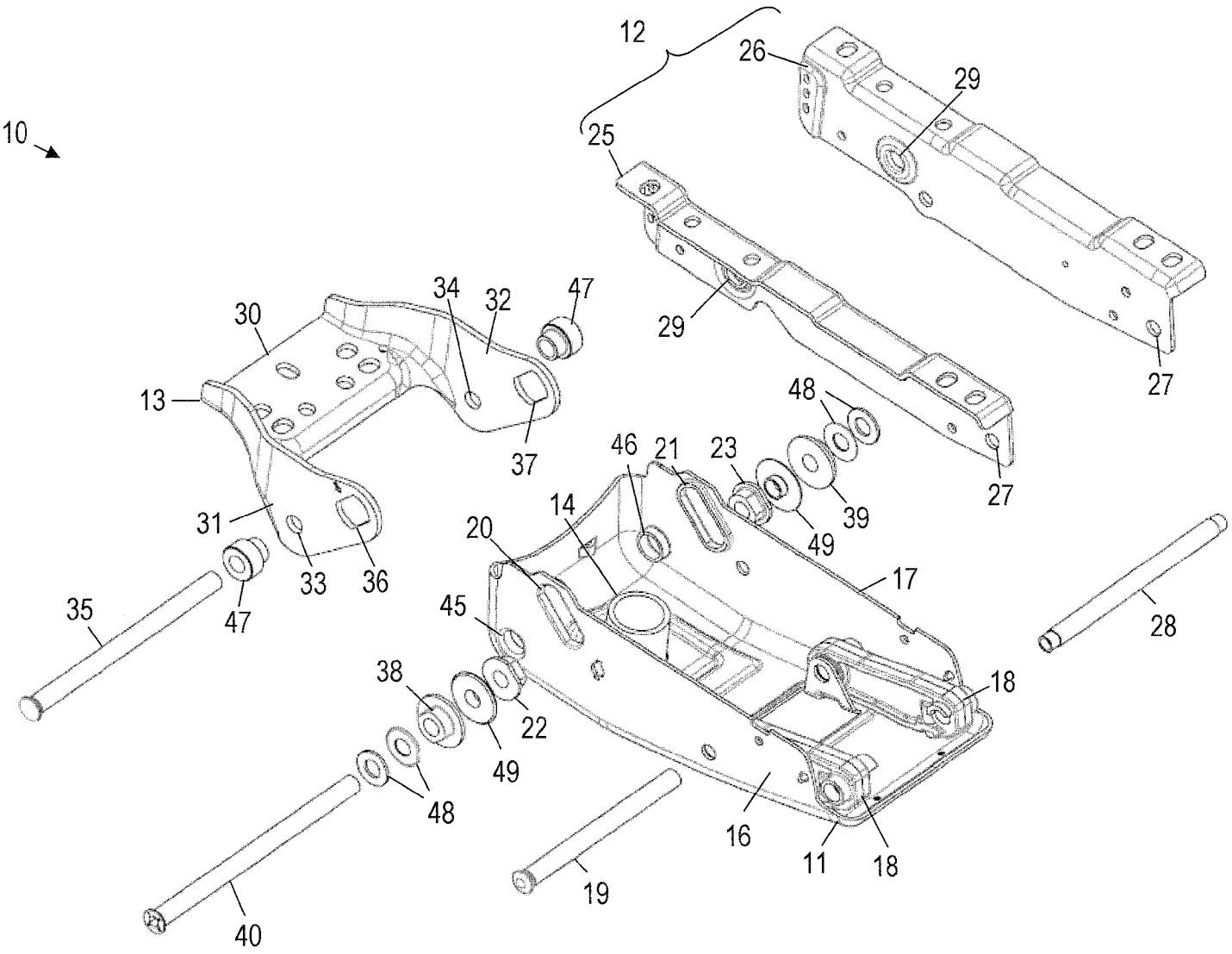
FIG. 2 is an exploded perspective view of a chair tilt mechanism according to an embodiment.

FIG. 2 is an exploded view of a tilt mechanism 10 according to an embodiment. The tilt mechanism 10 may be used to effect a coordinated motion of the chair seat and chair back.

Figure 14:
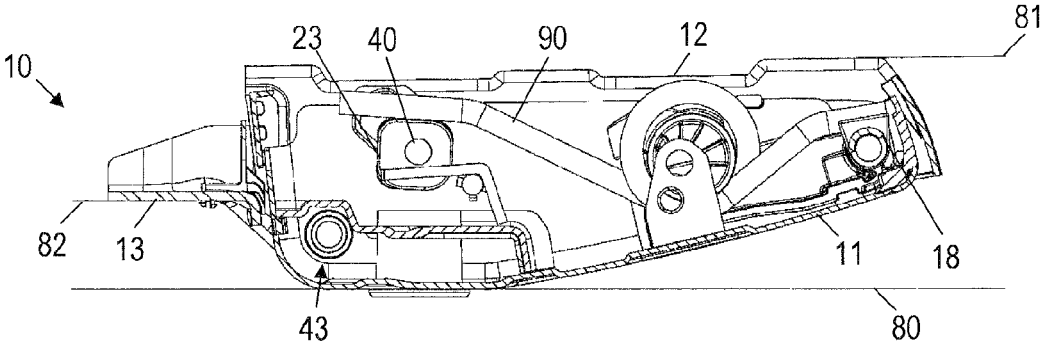
FIG. 14 is a cross-sectional view of the chair tilt mechanism of FIG. 2 in a zero-tilt position.
Figure 15:
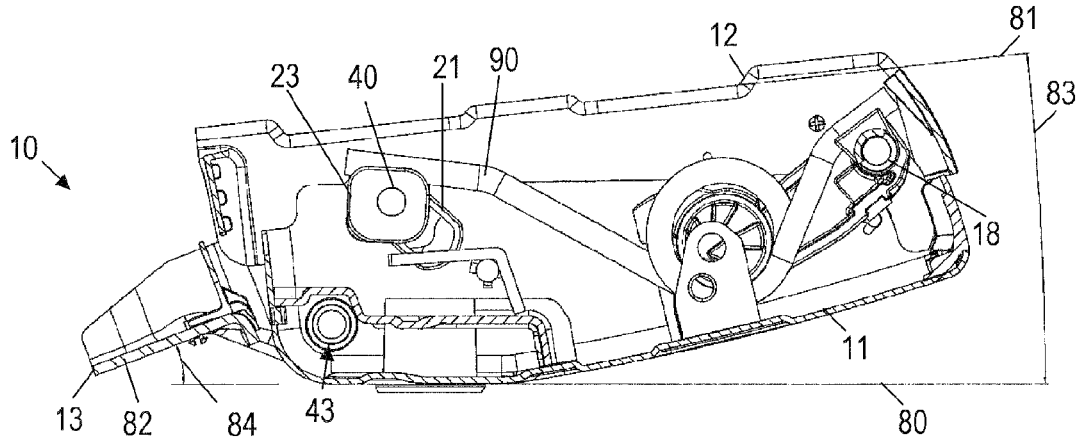
FIG. 15 is a cross-sectional view of the chair tilt mechanism of FIG. 2 in a full-tilt position.

The tilt mechanism 10 includes a base 11, a seat support 12, and a back support 13. Additional functional components may be housed in the interior of the housing defined by the base, such as a bias mechanism for biasing the tilt mechanism 10 into a rest position, corresponding to the zero-tilt position. A possible configuration of the bias mechanism is illustrated in FIG. 14 and FIG. 15.

The base 11 generally has a U-shaped cross-section in a plane extending in the lateral direction of the tilt mechanism 10. The base 11 has a bottom wall, on which a coupling arrangement 14 for coupling the tilt mechanism 10 to a chair base assembly is formed. The coupling arrangement 14 may include a cylindrical receptacle configured to receive a pedestal column. From the bottom of the base 11, there extend two side walls 16 and 17. The side walls 16, 17 may be provided to extend in the forward-backward direction of the tilt mechanism 10. The side walls 16, 17 may be provided such that, when the tilt mechanism 10 is installed in a chair, the side walls 16, 17 of the base 11 extend perpendicular to the horizontal plane defined as the plane on which the chair base assembly rests.

The seat support 12 includes a first bracket 25 and a second bracket 26. Other configurations may be used. For illustration, the seat support 12 may be one unitary component which extends at the lower side of the seat, and which has a top plate section extending between the mounts which attach the seat to the seat support 12. The seat support 12 is displaceably mounted to the base 11. The base 11 may include various types of mechanisms for implementing such a displaceable coupling. For illustration, an arrangement having a pair of links 18 is illustrated in FIG. 2. The links 18 are articulated to the base 11 via a pin 19 which extends across the base 11 in the lateral direction of the tilt mechanism 10. The links 18 are articulated to the seat support 12 via a pin 28 which extends between the first bracket 25 and the second bracket 26 in the lateral direction of the tilt mechanism 10. Alternative or additional components may be provided to define the movement of the forward end of the seat support 12 relative to the base 11. Examples for such components include sloping rails or flanges on which a front end of the brackets 25, 26 of the seat support 12 abut, or similar.

The base 11 is provided with first linear guide slots 20 and 21, which are formed in the side walls 16 and 17, respectively. The first linear guide slot 20, 21, in combination with a pin 40 slideably supported therein, allows the seat support 12 to be displaced relative to the base 11, with the pin 40 sliding along the first linear guide slots 20 and 21, respectively. This coupling mechanism will be described in more detail below.

The seat support 12 may include the first bracket 25 and the second bracket 26. Attachment portions for fixedly attaching a chair seat to the seat support 12 are provided on the seat support 12. The seat support 12 includes a pair of lateral side walls extending downwardly from the attachment portions. The side walls of the seat support 12 are arranged to extend generally parallel to the side walls 16 and 17 of the base 11. The side walls of the seat support 12 may remain parallel to the side walls 16 and 17 of the base 11 as the tilt mechanism 10 is actuated from the zero-tilt position to the full-tilt position.

Each side wall of the seat support 12 has a plurality of through openings. A through opening 29 is provided for fixing the pin 40 to the seat support 12. The pin 40 is slideably supported in the first linear guide slot 20 of the base, as will be described in more detail below, and a second guide slot of the back support 13. A through opening 27 may be provided for an articulated connection of the seat support 12 to the links 18 via the pin 28.

The back support 13 has an attachment portion 30 for fixedly attaching the chair back. The back support 13 further has side wings 31 and 32, respectively. The side wings 31 and 32 are arranged to extend parallel to the side walls 16 and 17 of the base 11. The back support 13 is pivotably coupled to the base 11. A through opening 33 is formed in the side wing 31, and another through opening 34 is formed in the side wing 32. Corresponding through openings 45, 46 are provided in the side walls 16 and 17 of the base 11, respectively. In the assembled state of the tilt mechanism 10, a pin 35 passes through the through opening 33 formed in the side wing 31 of the back support 13, the through openings 36 formed in the side walls 16 and 17 of the base 11, and the through opening 34 formed in the side wings 32 of the back support 13, thereby implementing a pivot coupling. Fasteners 47 may be used to attach the pin 35 to the base 11 and the back support 13.

The back support 13 is provided with second linear guide slots 36 and 37 formed in the side wings 31 and 32, respectively. As will be described in more detail below, the second linear guide slots 36 and 37, the first linear guide slots 20 and 21, and the pin 40 slideably supported therein implement a coupling mechanism which couples the back support 13 to the seat support 12 and the base 11. A first keyed sleeve 22 mounted on the pin 40 may project into the first linear guide slot 20. A further first keyed sleeve 23 mounted on the pin 40 may project into the further first linear guide slot 21. A second keyed sleeve 30 mounted on the pin 40 may project into the second linear guide slot 36. A further second keyed sleeve 39 mounted on the pin 40 may project into the further second linear guide slot 36. Washers 48, 49 may be provided on the pin 40.

The coupling mechanism which couples the back support 13 to both the base 11 and the seat support 12 will be described in more detail next.

In the assembled state of the tilt mechanism 10, the seat support 12 and the back support 13 are coupled to the base 11 via the coupling mechanism. The pin 40 is fixed to the seat support 12. The pin 40 may be passed through the through opening 29 formed in the side walls of the seat support 12. In the illustrated implementation, the first pin 40 has a length to extend between the side walls of the first bracket 25 and the second bracket 26, passing through corresponding through openings 29 in the opposite side walls of the seat support 12. The pin 40 is slideably supported in the first linear guide slot 20 formed in the side wall 16 of the base 11. The pin 40 is slideably supported in the first linear guide slot 21 formed in the opposite side wall 17 of the base 11. The first linear guide slots 20 and 21 are respectively formed as linear guide slots. I.e., the first linear guide slots 20 and 21 have a longitudinal center line which extends linearly from one longitudinal end of the first linear guide slot to the opposite longitudinal end of the first linear guide slot.

The boundary of the first linear guide slots 20 and 21 respectively has linear portions, extending parallel to the longitudinal axis of the respective first linear guide slot 20 or 21. The first keyed sleeve 22 supports the pin 40 in the first linear guide slot 20. The first keyed sleeve 22 has planar outer portions abutting on the linear boundary portions of the first linear guide slot 20. The pin 40 is received in a through opening formed in the first keyed sleeve 22. The pin 40 may be received in the through opening of the first keyed sleeve 22 so as to be rotatable relative to the first keyed sleeve 22. This arrangement allows the pin 40, received in the first keyed sleeve 22, to be displaced along the longitudinal axis of the first linear guide slot 20.

The further first keyed sleeve 23 supports the pin 40 in the further first linear guide slot 21 provided on the other side wall 17 of the base 11. The configuration and operation of the further first keyed sleeve 23, the further first linear guide slot 21 provided in the other side wall 17 and the pin 40 correspond to the configuration and operation of the first keyed sleeve 22, the first linear guide slot 20 and the pin 40 explained above.

The coupling mechanism is configured such that the pin 40 additionally also projects through the second linear guide slot 36. The pin 40 is slideably supported in the second linear guide slot 36 formed in the side wing 31 of the back support 13. The second linear guide slots 36 and 37 are respectively formed as linear guide slots. I.e., the second linear guide slots 36 and 37 have a longitudinal center line which extends linearly from one longitudinal end of the second linear guide slot to the opposite longitudinal end of the second linear guide slot.

The boundary of the second linear guide slots 36 and 37 respectively has linear portions, extending parallel to the longitudinal axis of the respective linear guide slot 36 or 37. The second keyed sleeve 38 supports the pin 40 in the second linear guide slot 36. The second keyed sleeve 38 has planar outer portions abutting on the linear boundary portions of the second linear guide slot 36. The pin 40 is received in a through opening formed in the second keyed sleeve 38. The pin 40 may be received in the through opening of the second keyed sleeve 38 so as to be rotatable relative to the second keyed sleeve 38. This arrangement allows the pin 40, received in the second keyed sleeve 38, to be displaced along the longitudinal axis of the second linear guide slot 36.

The further second keyed sleeve 39 supports the pin 40 in the further second linear guide slot 37 provided on the other side wing 32 of the back support 13. The configuration and operation of the further second keyed sleeve 39, the further second linear guide slot 37 provided in the other side wing 32 and the pin 40 correspond to the configuration and operation of the second keyed sleeve 38, the second linear guide slot 36 and the pin 40 explained above.

In the tilt mechanism 10, the coupling mechanism couples the back support 13 to both the base 11 and the seat support 12, using the pin 40 which projects through the first linear guide slot 20 and the second linear guide slot 36. The back support 13 is pivotably coupled to the base 11, such that the back support 13 pivots about a pivot axis defined by the pin 35 relative to the base 11. As the seat support 12 and the back support 13 are not merely coupled by a pivot connection, the rear end of the seat support 12, and thus the rear end of the chair seat, is not constrained to perform a radial movement.

Further, the characteristics of the tilt mechanism 10 may be controlled by appropriately selecting the slope of the first linear guide slot(s) and of the second linear guide slot(s). For illustration, the weight compensation affect and the seat angular movement may be controlled by appropriately setting the slope of the first linear guide slot. For illustration, by increasing the slope of the first linear guide slot provided in the base relative to the horizontal plane, i.e. relative to the plane extending parallel to the support plane of the chair when the tilt mechanism 10 is installed in the chair, the weight compensation affect may be increased while the seat angular movement may be reduced. In manufacture, the tilt mechanism 10 can be easily adapted to given customer requirements by forming the first linear guide slot and the second linear guide slot to have a desired direction. For illustration, the direction of the longitudinal axis of the first linear guide slot and the direction of the longitudinal axis of the second linear guide slot, relative to the horizontal plane when the mechanism is in the zero-tilt position, may be controlled to accommodate various customer needs and requirements imposed by the chair design.

The second linear guide slot(s) 36, 37 provided on the back support 13 are formed such that they slope upward in a forward direction when the tilt mechanism 10 is in a zero-tilt position. Thereby, self-weighing characteristics are attained. The second linear guide slot(s) 36, 37 may be formed such that they slope upward in the forward direction for any tilt position in which the back bracket 13 may be located relative to the base 11. The forward direction of the tilt mechanism may be defined as the direction which faces away from the side at which the back support 13 projects from the base 11 and which is perpendicular to a longitudinal axis of the coupling arrangement 14 of the base 11.

The first linear guide slot(s) 20, 21 provided on the base 11 may be arranged such that they slope downward in the forward direction of the tilt mechanism 10. This allows the second linear guide slot(s) 36, 37 to drive the pin 40 along the second linear guide slot(s) 36, 37 via a shear action.

The tilt mechanism 10 in which the coupling mechanism includes a pin attached to the seat support 12 which is slideably received both in the first linear guide slot 20 of the base 11 and in the second linear guide slot 36 of the back bracket 13 has a simple construction. Still, the movement of the seat support 12 is not limited to a purely radial movement relative to the back support 13.

The operation of the tilt mechanism 10 will be explained in more detail with reference to FIGS. 3-15.

Figure 3:
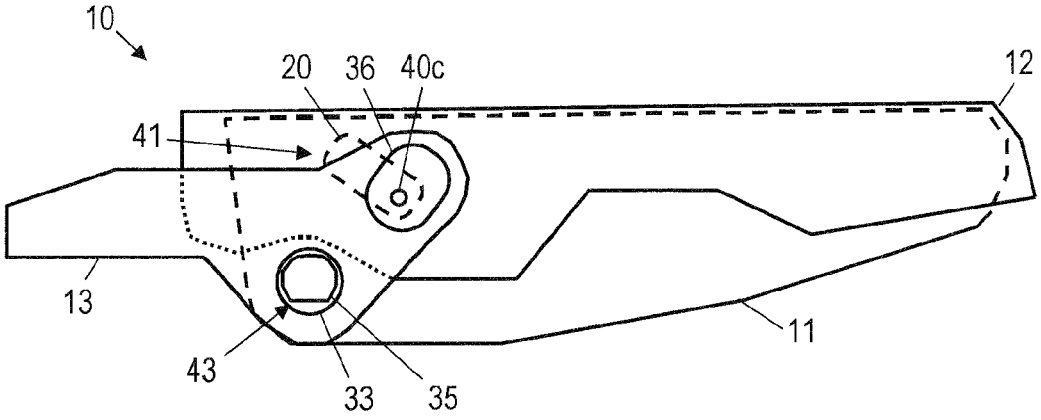
FIG. 3 is a schematic side view, also illustrating the position of hidden components, of a chair tilt mechanism according to an embodiment in the zero-tilt position.
Figure 4:
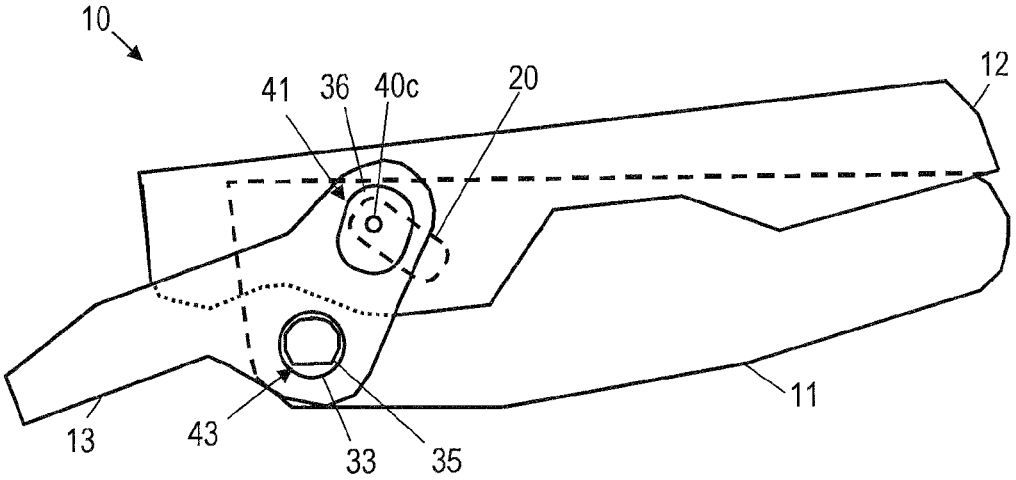
FIG. 4 is a schematic side view, also illustrating the position of hidden components, of the chair tilt mechanism of FIG. 3 in a position corresponding to a finite chair back tilt angle.

FIG. 3 shows a side view of the tilt mechanism 10 in the zero-tilt position. FIG. 4 shows a side view of the tilt mechanism 10 in a position in which the back is reclined. Portions of the seat support 12 hidden by the back support 13 are indicated by dotted lines. Portions of the base 11 hidden by the back support 13 or the seat support 12 are indicated by dashed lines. The center of the pin 40 is indicated by 40*c*. The coupling mechanism is generally indicated at 41.

The coupling mechanism 41 is generally arranged in a rearward portion of the tilt mechanism 10. The pivot coupling 43 for pivotably coupling the back support 13 and the base 11 is provided at a rear end of the base 11.

In use of the tilt mechanism 10, the back support 13 is pivoted relative to the base 11 about the pivot coupling 43. When the back support 13 pivots relative to the base 11, the second linear guide slot 36 provided in the back support 13 is also pivoted relative to the base 11. The pivoting movement of the second linear guide slot 36 drives the pin 40 along the longitudinal axis of the second linear guide slot 36, and also along the longitudinal axis of the first linear guide slot 20. The second linear guide slot 36 drives the pin 40 along the first linear guide slot 20 via a shear action when the back bracket 13 pivots relative to the base 11. The movement of the pin 40 causes the seat support 12 to be displaced relative to the base 11.

When the tilt mechanism 10 is installed in a chair, a reclining motion of the chair back will cause the pin 40 to be displaced along both the first linear guide slot 20 and the second linear guide slot 36, resulting in a movement of the seat support 12 which is coordinated with the reclining motion of the chair back. The motion of the seat support 12 causes the chair seat directly coupled to the seat support 12 to be displaced in a corresponding manner. The resulting movement of the chair seat, and in particular of the rear end of the chair seat, may be defined by suitably selecting the slope of the first and second guide slots. The force applied onto the back bracket 13 by the tilt mechanism depends on the user's weight.

Figure 5:
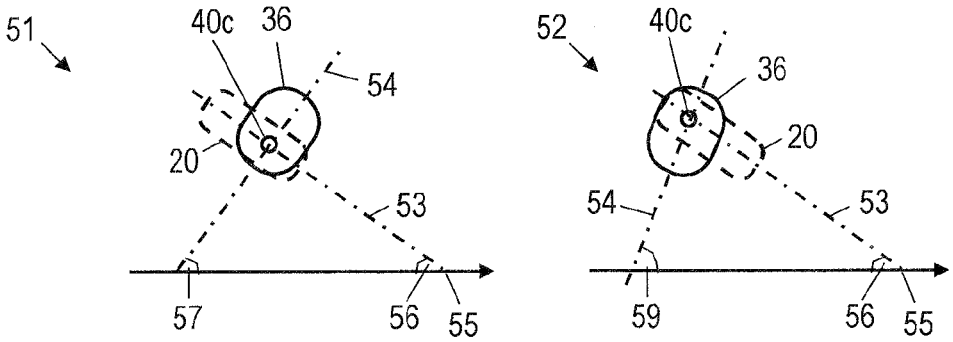
FIG. 5 is a detail view illustrating the configuration of a coupling mechanism in the states shown in FIG. 3 and FIG. 4, respectively.

FIG. 5 illustrates the state of the coupling mechanism in greater detail when a tilt mechanism is brought from a zero-tilt position to a position corresponding to a finite chair back tilt angle. At 51, the configuration of the coupling mechanisms is illustrated for the zero-tilt position of the tilt mechanism. At 52, the configuration of the coupling mechanisms is illustrated for a tilted position in which the back support 13 has been pivoted relative to the basis.

In the zero-tilt position indicated at 51, a longitudinal axis 53 of the first linear guide slot 20 slopes downwardly in a forward direction 55 of the tilt mechanism. The longitudinal axis 53 of the first linear guide slot 20 encloses a first angle 56 with the horizontal plane. A longitudinal axis 54 of the second linear guide slot 36 slopes upwardly in the forward direction 55 of the tilt mechanism 10. The longitudinal axis 54 of the second linear guide slot 36 encloses a second angle 57 with the horizontal plane. The center 40*c* of the pin 40 is located at the intersection point of the longitudinal axis 53 of the first linear guide slot 20 and the longitudinal axis 54 of the second linear guide slot 36.

Upon transition to the tilted position indicated at 52, the pin 40 is driven along the longitudinal axis 53 of the first linear guide slot 20 and along the longitudinal axis 54 of the second linear guide slot 36. In the tilted position, the longitudinal axis 54 of the second linear guide slot 36 still slopes upwardly in the forward direction 55. In the tilted position, the longitudinal axis 54 of the second linear guide slot 36 encloses a second angle 59 with the horizontal plane which is greater than the second angle 57 in the zero-tilt position indicated at 51.

In the zero-tilt position of the tilt mechanism, the pin 40 may be located towards a lower end of the first linear guide slot 20 and a lower end of the second linear guide slot 36. Upon transition from the zero-tilt position to the full-tilt position, the pin 40 may move upward from the lower ends of the guide slots, i.e., the pin 40 may move towards an upper end of the first linear guide slot 20 and an upper end of the second linear guide slot 36 as the tilt angle increases.

An angle between the longitudinal axis 53 of the first linear guide slot and the longitudinal axis 54 of the second linear guide slot 36 may decrease as the tilt angle increases. A good weight compensation affect may thereby be attained.

Various arrangements of the first and second linear guide slots may be implemented. For illustration, the longitudinal axis 53 of the first linear guide slot 20 may enclose a first angle 56 of 42° with the horizontal plane. The first angle 56 may be included in the range from 32° to 45°, for example. If the first angle 56 is made larger, i.e. if the first linear guide slot 20 is arranged so as to extend steeper relative to the horizontal plane, the weight compensation affect may be increased. If the first angle 56 is selected to be smaller, the weight compensation affect may be decreased.

For further illustration, the longitudinal axis 54 of the second linear guide slot 36 may enclose a second angle 57 of 50° with the horizontal plane when the tilt mechanism is in a zero-tilt position. The second angle 57 may be included in the range from 45° to 55°, for example, when the tilt mechanism is in a zero-tilt position. The second angle 57 may be selected such that the longitudinal axis 54 of the second linear guide slot 36 always slopes upwardly in the forward direction 55 while the back support 13 pivots from the zero-tilt position to the full-tilt position. The longitudinal axis 54 of the second linear guide slot 36 may be made to pivot by more than 20°, e.g. by 21°, from the zero-tilt position to the full-tilt position. By altering the second angle 57, the ride characteristics of the tilt mechanism 10 may be adapted.

By adapting the slope of the first linear guide slot 20 and the second linear guide slot 36, the requirements imposed by different types of chairs in which the tilt mechanism is to be used may be readily accommodated upon manufacture of the tilt mechanism. The tilt mechanism 10 still has a simple construction which does not require dedicated second pins different from the pin 40 which move along the second linear guide slot(s) 36, 37.

FIGS. 6-11 illustrate the operation of the chair tilt mechanism of FIG. 2 in more detail.

Figure 6:
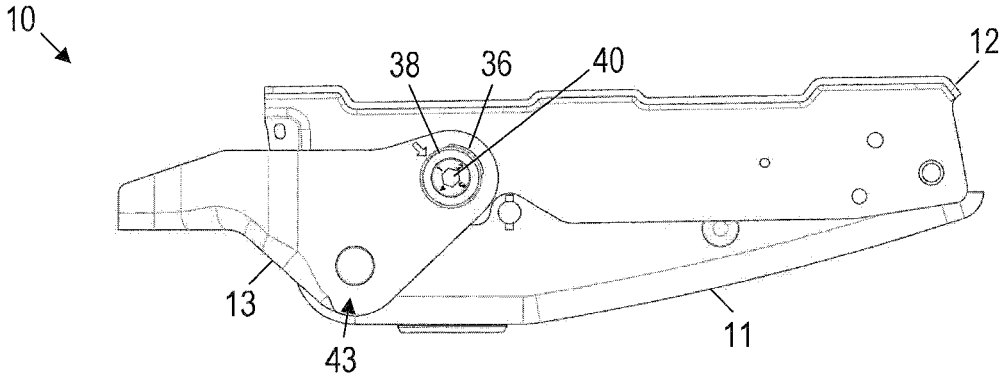
FIG. 6 is a side view of the chair tilt mechanism of FIG. 2 in a zero-tilt position.
Figure 7:
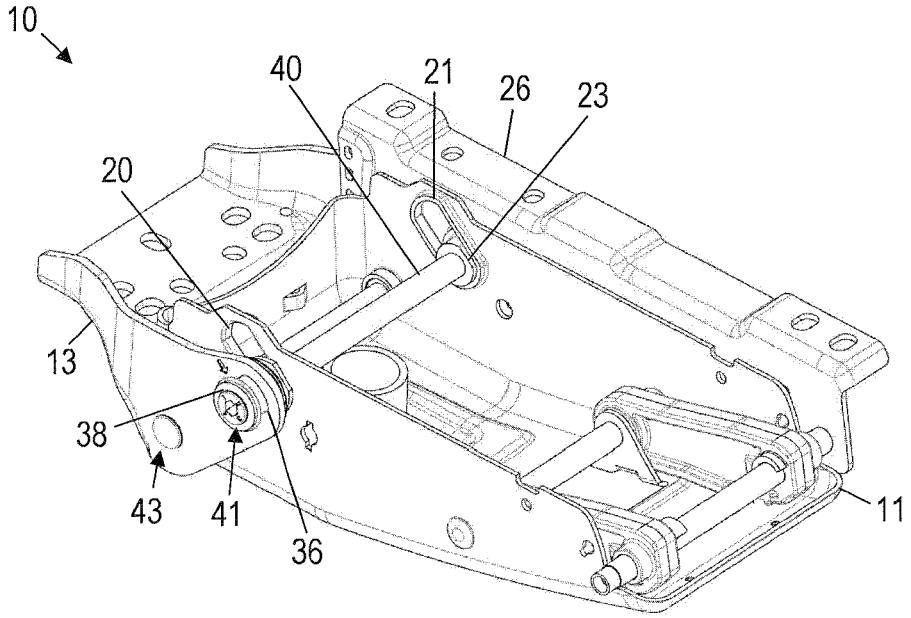
FIG. 7 is a partially broken away perspective view of the chair tilt mechanism of FIG. 2 in the zero-tilt position.

FIG. 6 shows a side view of the chair tilt mechanism in a zero-tilt position. FIG. 7 shows a perspective view of the chair tilt mechanism in the zero-tilt position, with bracket 25 of the seat support 12 removed.

In the zero-tilt position, the pin 40 may be positioned at its lowermost position in the first linear guide slot 20. The first keyed sleeve 22, which supports the pin 40 in the first linear guide slot 20, may abut on one end of the first linear guide slot 20 in the zero-tilt position.

In the zero-tilt position, the pin 40 may be positioned at its lowermost position in the second linear guide slot 36. The second keyed sleeve 38, which supports the pin 40 in the second linear guide slot 36, may abut on one end of the second linear guide slot 36 in the zero-tilt position.

Figure 8:
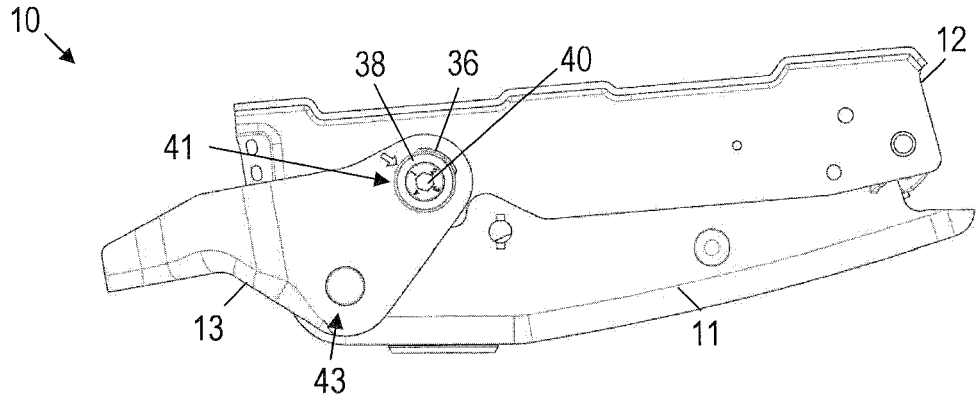
FIG. 8 is a side view of the chair tilt mechanism of FIG. 2 in an intermediate tilt position.
Figure 9:
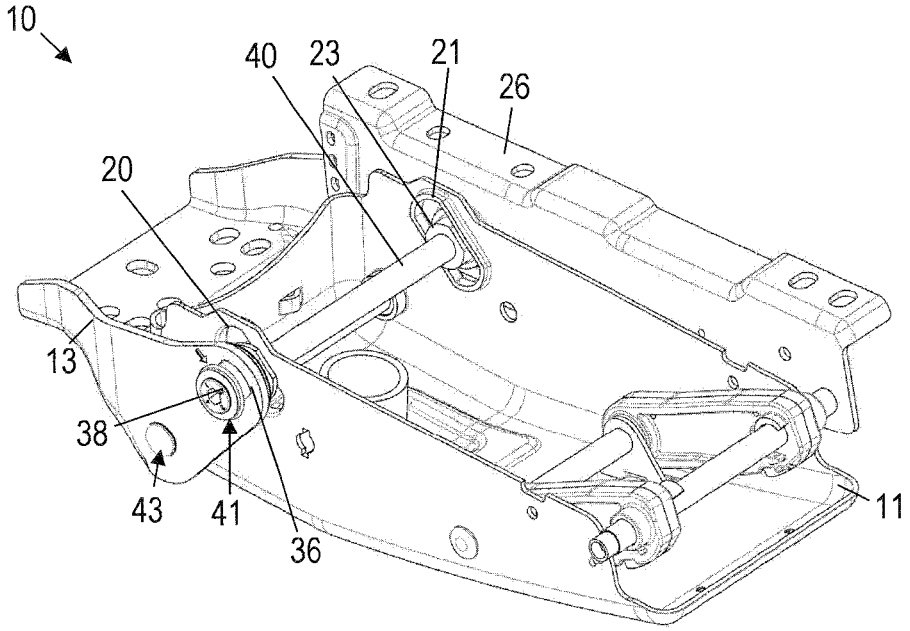
FIG. 9 is a partially broken away perspective view of the chair tilt mechanism of FIG. 2 in the intermediate tilt position.

FIG. 8 shows a side view of the chair tilt mechanism in an intermediate tilt position. FIG. 9 shows a perspective view of the chair tilt mechanism in the intermediate tilt position, with bracket 25 of the seat support 12 removed.

In the intermediate tilt position, the back support 13 has been pivoted about the pivot 43 through an angle relative to the zero-tilt position. This causes the pin 40 to travel along the longitudinal axis of the second linear guide slot 36, jointly with the second keyed sleeve 38 in which it is received, and along the longitudinal axis of the first linear guide slot 20, jointly with the first keyed sleeve 22. The movement of the second linear guide slot 36 about pivot 43 forces the pin 40 to move along the longitudinal axis of the first linear guide slot 20 via a shear action.

In the intermediate tilt position shown in FIGS. 8 and 9, the first keyed sleeve 22 may be spaced from both longitudinal ends of the first linear guide slot 20. The second keyed sleeve 38 may be spaced from both longitudinal ends of the second linear guide slot 20. The displacement of the pin 40 along the first linear guide slot 20 and the second linear guide slot 36 causes the seat support 12 to be moved relative to the seat base 11, as best seen in FIG. 8.

Figure 10:
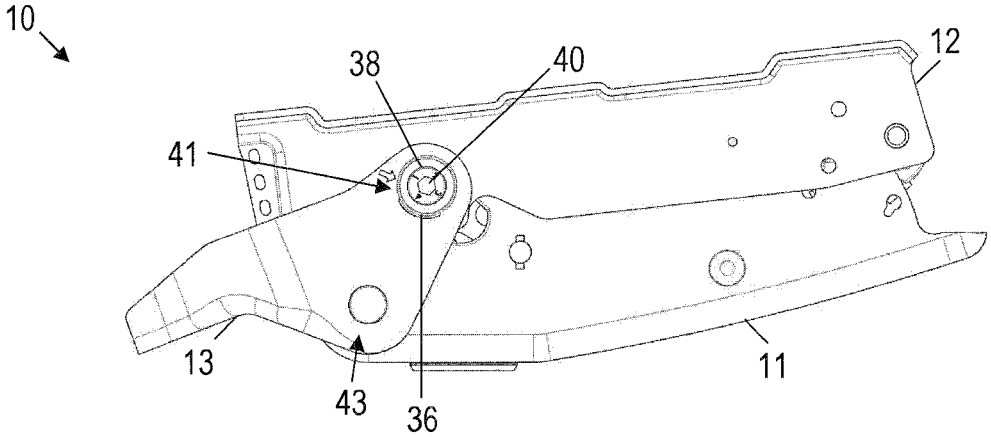
FIG. 10 is a side view of the chair tilt mechanism of FIG. 2 in a full-tilt position.
Figure 11:
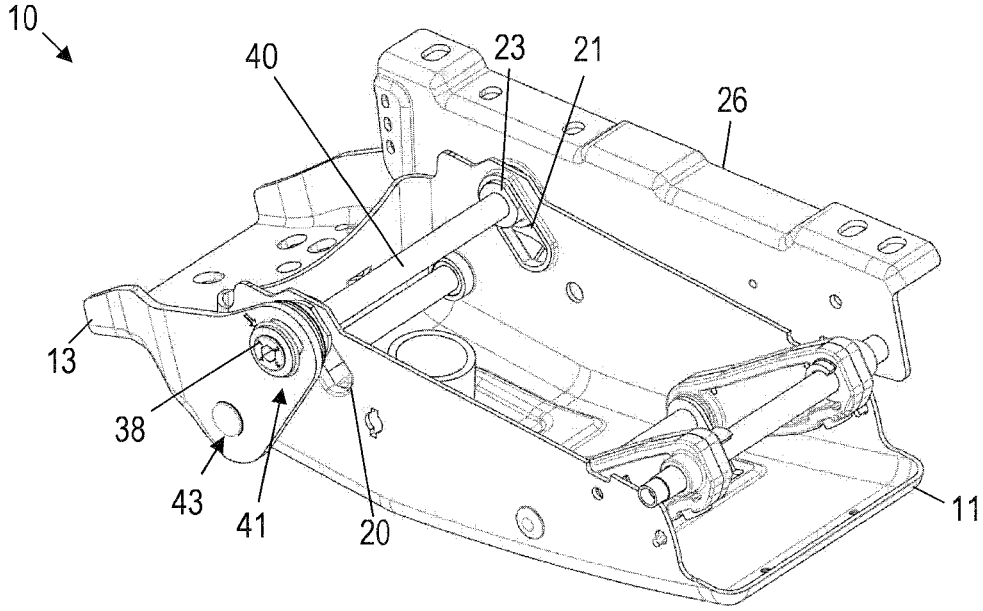
FIG. 11 is a partially broken away perspective view of the chair tilt mechanism of FIG. 2 in the full-tilt position.

FIG. 10 shows a side view of the chair tilt mechanism in a full-tilt position. FIG. 11 shows a perspective view of the chair tilt mechanism in the full-tilt position, with bracket 25 of the seat support 12 removed.

In the full-tilt position, the back support 13 has been pivoted further about the pivot 43 through an angle relative to the zero-tilt position. This causes the pin 40 to travel along the longitudinal axis of the second guide hole 36, jointly with the second keyed sleeve 38 in which it is received, and along the longitudinal axis of the first linear guide slot 20, jointly with the first keyed sleeve 22 in which it is received. In the full-tilt position shown in FIGS. 10 and 11, the first keyed sleeve 22 may come into abutment with the upper end of the first linear guide slot 20, and the second keyed sleeve 38 may come into abutment with the upper end of the second linear guide slot 36.

The pin 40 may travel along the longitudinal axes of the first linear guide slot 20 and the second linear guide slot 36 monotonously in one direction when the back support 13 is reclined from its foremost to its rearmost position. For illustration, the pin 40 may travel along the longitudinal axis of the first linear guide slot 20 and along the longitudinal axis of the second linear guide slot 36 in one direction, e.g. towards the upper ends of these guide slots, while the tilt mechanism is brought from a zero-tilt position to the full-tilt position.

The orientation of the first linear guide slot 20 and of the second linear guide slot 36 in the zero-tilt position may be selected depending on a desired recline characteristics and, in particular, depending on the desired weight compensation affect. The orientation of the first linear guide slot 20 and the second linear guide slot 36 in the zero tilt position may be selected such that the distance by which the pin 40 is displaced along the second linear guide slot 36 is less than the distance by which the pin 40 is displaced along the first linear guide slot 20.

Figure 12:
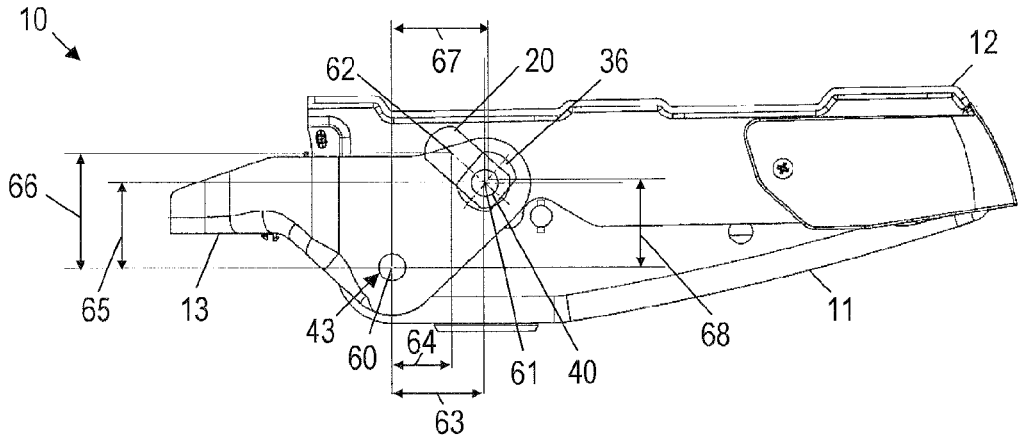
FIG. 12 is a side view of the chair tilt mechanism of FIG. 2 illustrating the configuration of the coupling mechanism in greater detail.

FIG. 12 is a side view of the tilt mechanism 10 in the zero-tilt position. The pivot coupling 43 between the back support 13 and the base 11 defines a pivot axis 60. In the zero-tilt position, the center of the pin 40 is disposed a horizontal distance 63 forward of the pivot axis and a vertical distance 65 above the pivot axis 60. When the back support 13 tilts in a rearward direction, the pin 40 moves from a lowermost position 61 to an uppermost position 62 in the first linear guide slot 20. The horizontal distance from the pivot axis 60 decreases to horizontal distance 64, while the vertical distance above the pivot axis 60 increases to vertical distance 66 as the back support 13 tilts from the zero-tilt position to the full-tilt position.

The movement path of the pin 40 in the second linear guide slot 36 may be such that the pin 40 is displaced by a smaller distance in the second linear guide slot 36. For illustration, the position in the second linear guide slot 36 to which the pin 40 is displaced when the back support 13 pivots to the full-tilt position may have coordinates 67 and 68 (measured in a system in which the tilt mechanism is in the zero-tilt position) which are only slightly offset from the coordinates 63, 65 of the pin 40 in the zero-tilt position.

As illustrated in FIG. 12, the second linear guide slot 36 may be positioned on the back support 13 in such a way that a longitudinal axis of the second linear guide slot 36 points towards the pivot axis 60. The longitudinal axis of the second linear guide slot 36 may pass through the pivot axis 60.

Figure 13:
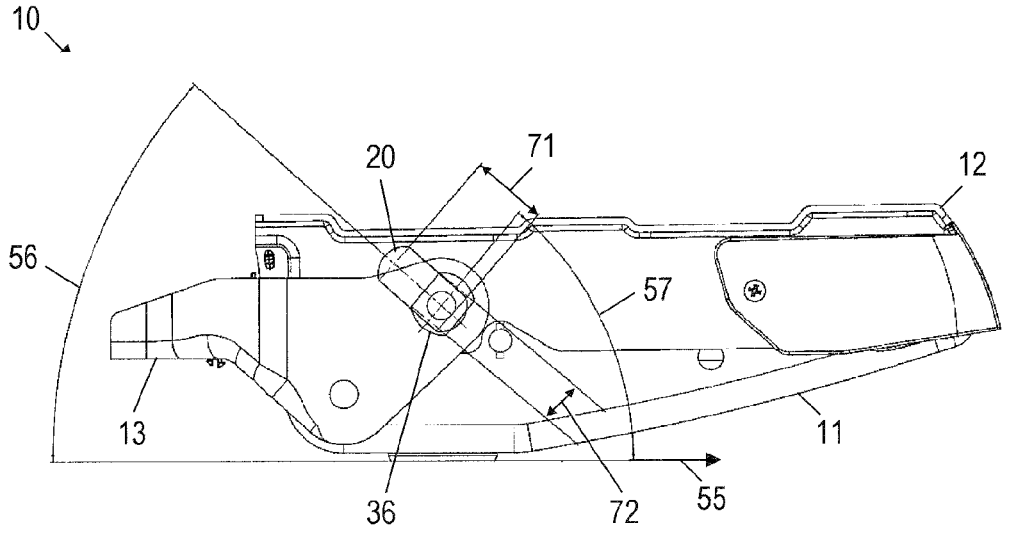
FIG. 13 is a side view of the chair tilt mechanism of FIG. 2 illustrating the configuration of the coupling mechanism in greater detail.

FIG. 13 is a side view of the tilt mechanism 10 in the zero-tilt position.

The first linear guide slot 20 may slope downwardly in the forward direction 55. The first angle 56 between a longitudinal axis of the first linear guide slot 20 and the forward direction 55 may be included in a range from 32° to 45°. The first angle 56 may be about 42°, for example.

The second linear guide slot 36 slopes upwardly in the forward direction 55. The second angle 57 between a longitudinal axis of the second linear guide slot 36 and the forward direction 55 may be included in a range from 45° to 55°. The second angle 57 may be about 50°, for example. Such angles provide good weight compensation affects.

The first linear guide slot 20 may have a length 71 which is greater than a length 72 of the second linear guide slot 36. Ends of the first linear guide slot 20 and the second linear guide slot 36 may then act as end stops for movement of the pin 40. The length 71 of the first linear guide slot 20 may be included in a range from 20 mm to 30 mm. The length 72 of the second linear guide slot 36 may be included in a range from 12 mm to 18 mm. The length 71 or 72 of a linear guide slot may respectively be defined as the length of the straight boundary section which is parallel to the longitudinal axis of the respective linear guide slot.

FIG. 14 and FIG. 15 show cross-sectional views of the tilt mechanism 10. FIG. 14 shows a zero-tilt position. FIG. 15 shows a full-tilt position. The coupling mechanism causes a coordinated movement of the seat support 12 and the back support 13. The top of the seat support defines a seat mount plane 81 for the seat. The seat mount plane 81 may also be tilted relative to a horizontal plane 80 when the chair back is reclined. In the zero-tilt position, the seat mount plane 81 may be arranged at a small angle relative to the horizontal plane. For illustration, the seat mount plane 81 may be arranged at an angle of less than 1°, e.g. of 0.8°, relative to the horizontal plane 80. Tilting of the back support 13 causes the seat support 12 to be displaced relative to the base 11. The angle between the seat mount plane 81 and the horizontal plane 80 may increases to an angle 83 upon transition to the full-tilt position. The angle 83 may be greater than 5° and may be included in a range from 5° to 10°, for example.

The angle by which the seat mount plane 81 is tilted may be less than an angle 84 by which the back support 13 is tilted. For illustration, the back support 13 may be tilted by an angle which is greater than 15°. The back support 13 may be tilted by an angle which is greater than 20°, e.g. 21°, upon transition from the zero-tilt position to the full-tilt position. This is best seen in FIG. 14 and FIG. 15, where a portion 82 of the back support 13 is parallel to the horizontal plane 80 in the zero-tilt position and is arranged at an angle 84 of about 21° relative to the horizontal plane 80 in the full-tilt position.

The tilt mechanism 10 may have a bias mechanism which biases the tilt mechanism 10 towards the zero-tilt position. The bias mechanism may comprise an energy storage means 90, as shown in FIG. 14 and FIG. 15. When the back support 13 tilts rearward from the zero-tilt position, energy is stored in the energy storage means 90. The energy storage means 90 may comprise a spring. As illustrated in FIG. 14 and FIG. 15, the energy storage means 90 may comprise a torsion spring. Other implementations of the energy storage means 90 may be used. For illustration, the energy storage means 90 may comprise one or several spring blades.

The energy storage means 90 may be coupled to the links 18 and/or the pin 40 to bias the tilt mechanism 10 towards the zero-tilt position. As shown in FIG. 14 and FIG. 15, the energy storage means 90 may be coupled to the links 18 via pin 28. The energy storage means 90 may also be coupled to the pin 40. As the pin 40 moves upward and/or the links 18 move upward, energy is stored in the energy storage means 90. When no external force is applied onto the chair back 4, the energy storage means 90 causes the pin 40 to move downward in both the first linear guide slot 36 and the second linear guide slot 20.

While the state of the first and second coupling mechanisms at respectively one lateral side of the tilt mechanism is illustrated in detail in FIGS. 6-15, the first and second coupling mechanisms provided on the opposite lateral sides of the tilt mechanism have states corresponding to the ones illustrated in FIGS. 6-15. For illustration, the position of the pin 40 and of the first keyed sleeve 22 relative to the first linear guide slot 20 formed in the side wall 16 of the base 11 will generally correspond to the position of the pin 40 and of the further first keyed sleeve 23 relative to the further first guide slot 21 formed in the opposite side wall 17 of the base 11. Similarly, the position of the pin 40 and of the further second keyed sleeve 39 relative to the further second guide slot 37 formed in the side wing 32 of the back support 13 will generally correspond to the position of the second pin 44 and of the second keyed sleeve 38 relative to the second linear guide slot 36 formed in the side wing 31 of the back support 13.

While tilt mechanisms 10 according to embodiments have been described in detail with reference to the drawings, modifications thereof may be implemented in further embodiments. For illustration, additional mechanisms may be integrated into the tilt mechanism 10 to implement additional functionalities. Such mechanisms may include a mechanism for adjusting a restoring force of the chair back, or similar.

For further illustration, while tilt mechanisms have been described in which a single pin is slideably supported in two first linear guide slots formed on the base and two second linear guide slots formed on the back support, one pin may be provided on one lateral side of the tilt mechanism and a separate further pin may be provided on the opposite lateral side of the tilt mechanism in further embodiments.

For further illustration, while tilt mechanisms have been described in which the first linear guide slot and the second linear guide slot are formed as through slots, at least one of the linear guide slots may also be a blind slot.

While exemplary embodiments have been described in the context of office-type chairs, the tilt mechanisms and chairs according to embodiments of the invention are not limited to this particular application. Rather, embodiments of the invention may be employed to effect a coordinated motion of a chair back and chair seat in a wide variety of chairs.

The invention claimed is:

1. A tilt mechanism for a chair, configured to effect a coordinated movement of a chair seat and chair back, said tilt mechanism comprising:

a base;

a first support configured to support a chair seat;

a second support configured to support a chair back and pivotably coupled to said base;

a coupling mechanism comprising:

(1) a pin attached to the first support;

(2) a first linear guide slot provided on said base; and (3) a second linear guide slot provided on said second support, (4) wherein said pin is slideably received in both said first linear guide slot and said second linear guide slot, and (5) wherein said second linear guide slot slopes upwardly in a forward direction of said tilt mechanism when said tilt mechanism is in a zero-tilt position, to drive said pin along said first linear guide slot when said second support pivots relative to said base.

2. The tilt mechanism of claim 1, said second linear guide slot being configured to drive said pin along said first linear guide slot via a shear action.

3. The tilt mechanism of claim 1, said second linear guide slot being pivoted relative to said forward direction and remaining sloped upwardly relative to said forward direction when said second support pivots relative to said base.

4. The tilt mechanism of claim 1, said first linear guide slot sloping downwardly in a forward direction of said tilt mechanism.

5. The tilt mechanism of claim 4, wherein said first linear guide slot has a longitudinal axis arranged at a first angle relative to said forward direction, said first angle being included in a range from 32° to 45°.

6. The tilt mechanism of claim 1, wherein said second linear guide slot has a longitudinal axis arranged at a second angle relative to said forward direction, said second angle being included in a range from 45° to 55° when said tilt mechanism is in a zero-tilt position.

7. The tilt mechanism of claim 1, wherein said first linear guide slot has a slot length which is greater than a slot length of the second linear guide slot.

8. The tilt mechanism of claim 1, further comprising a link coupling said first support to said base, said link being articulated to said base and said first support.

9. The tilt mechanism of claim 8, further comprising an energy storage mechanism coupled to said link.

10. The tilt mechanism of claim 9, said energy storage mechanism being coupled to both the pin and the link.

11. The tilt mechanism of claim 1, wherein said coupling mechanism further comprises a first keyed sleeve projecting into said first linear guide slot and a second keyed sleeve projecting into said second linear guide slot, said first keyed sleeve and said second keyed sleeve being mounted to said pin.

12. The tilt mechanism of claim 1, wherein said coupling mechanism comprises a further first linear guide slot on said base, said first linear guide slot and said further first linear guide slot being provided on opposing side walls of said base, and wherein said coupling mechanism comprises a further second linear guide slot on said second support, said second linear guide slot and said further second linear guide slot being provided on opposing side walls of said second support.

13. A chair, comprising:

a chair base assembly;

a chair seat;

a chair back; and a tilt mechanism comprising:

(1) a base coupled to said chair base assembly;

(2) a first support supporting said chair seat;

(3) a second support supporting said chair back and pivotably coupled to said base;

(4) a coupling mechanism comprising:

a) a pin attached to the first support;

b) a first linear guide slot provided on said base; and c) a second linear guide slot provided on said second support, d) wherein said pin is slideably received in both said first linear guide slot and said second linear guide slot;

e) wherein said second linear guide slot slopes upwardly in a forward direction of said tilt mechanism when said tilt mechanism is in a zero-tilt position, to drive said pin along said first linear guide slot when said second support pivots relative to said base.

* * * * *